United States Patent [19]

Seegmiller

[11] Patent Number: 4,666,345

[45] Date of Patent: May 19, 1987

[54] ROCK BOLT STRUCTURE

[76] Inventor: Ben L. Seegmiller, 3500 Loren Von Dr., Salt Lake City, Utah 84124

[21] Appl. No.: 797,936

[22] Filed: Nov. 14, 1985

[51] Int. Cl.[4] ..... E21D 20/02

[52] U.S. Cl. ..... 405/260; 405/259; 411/452; 411/478

[58] Field of Search ..... 405/259, 260; 411/479, 411/478, 477, 446, 447, 451–456, 19, 512, 516, 521, 61

[56] References Cited

U.S. PATENT DOCUMENTS

| | | | |
|---|---|---|---|
| 141,810 | 8/1873 | Nichols | 411/478 |
| 2,157,216 | 5/1939 | Pollard | 411/479 X |
| 2,412,517 | 12/1946 | Klein | 411/452 |
| 2,754,716 | 7/1956 | Bourns | 411/478 |
| 3,196,583 | 7/1965 | Rex et al. | 411/446 X |
| 3,415,153 | 12/1968 | Steiner | 411/512 |
| 3,653,217 | 4/1972 | Williams | 405/260 |
| 4,012,913 | 3/1977 | Scott | 405/259 |
| 4,087,928 | 5/1978 | Mickus | 411/512 X |
| 4,098,087 | 7/1978 | Swain | 405/259 |
| 4,284,379 | 8/1981 | Chaiko | 405/259 |
| 4,502,818 | 3/1985 | Elders | 405/259 |

FOREIGN PATENT DOCUMENTS

| | | | |
|---|---|---|---|
| 1069159 | 2/1954 | France | 411/452 |
| 601643 | 7/1978 | Switzerland | 405/259 |
| 591633 | 2/1978 | U.S.S.R. | 411/447 |

*Primary Examiner*—Dennis L. Taylor

*Attorney, Agent, or Firm*—M. Ralph Shaffer

[57] ABSTRACT

An elongate hollow rock bolt, bolt installations, and process of effecting the same, wherein the bolt is slightly over-size relative to the transverse cross-section of the mine roff hole or aperture in which the bolt is to be installed. The bolt has a radial, transverse polygonal cross-section formed by contiguous deflectable resilient sides provided with outwardly directed fins, the latter being tapered. When the bolt is impact-forced into a mine roof aperture, the fins are forced inwardly, deflecting the bolt sides which, owing to their resiliency, maintain the fins and the aperture wall areas contacting the same under compression, thus increasing the holding effect upon the bolt. The latter may be grouted in, and also may have a pre-installed bearing plate provided with an aperture and slide-slots accommodating the fins.

10 Claims, 9 Drawing Figures

ROCK BOLT STRUCTURE

FIELD OF INVENTION

The present invention relates to rock bolt structures and, more particularly, provides a rock bolt constructed to minimize corrosive effects and yet provide for compressive installation by virtue of the employment of fins and resilient flexure structure supporting such fins, so that maximum holding power is obtained minimum of surface contact of the rock bolt with the wall of the formation hole in which it is impacted.

DESCRIPTION OF PRIOR ART

In the past there have been many types of rock bolts that have been fabricated for use in rock formations. The bolts have conventionally been of solid bars. Recently, however, there have been new approaches taken in connection with the design of rock bolts so as to create compressive forces in roof bolt installations. One manner of accomplishing this has been to use a hollow bolt with a split wall, and them simply impact urge the same into the mine roof hole such that the hole tends to close the slit in the wall of the tube comprising the shank of the bolt. Another method that has been employed is to use a bolt with a S-shaped cross-section, the outer extremities of the "S" being slightly larger than the cross-sectional diameter of, e.g., a mine roof hole. Accordingly, when one forces the same into the hole the "S" becomes slightly compressed, tending to supply compressive forces, by virtue of the "S" configurement of the cross-section of the bolt against the hole wall.

Both of these advanced approaches nonetheless have difficulty in that the top and bottom of the "S" or the circumference of the split "C" of the other type of bolt, produces a substantial surface contact of the bolt with the wall of the hole. This can be very unwanted, owing to corrosive effects of rock materials surrounding the bolt receiving apertures. In many types of installations such as those in uranium mines, and others as well, there will be certain acidic conditions or other conditions that will eat into the contacting surfaces of the bolt, causing early failure of the installation through corrosive effects.

OBJECTS

Accordingly, it is an object of the present invention to provide a new and improved rock bolt.

It is a further object of the invention to provide a roof bolt for mines which will encounter minimum corrosive effects upon installation in mine roofs or other structures or formations.

An additional object of the invention is to provide a rock bolt having a series of fins the edges of which will be compression loaded upon installation of the bolt, this to increase the retentive hold of the bolt installation as well as restricting corrosive effects substantially to the fin edges of the bolt.

A further object is to provide a rock bolt than can be easily grouted in, whereby to maximize holding power of the bolt.

An additional object is to provide a rock bolt and bearing plate combination wherein the bolt is provided with suitable fins and the bearing plate with fin accommodating apertures, thereby allowing pre-placement of the bearing plate on the bolt prior to its impact installation in a rock formation hole.

A further object is to provide a new method for effecting a rock bolt installation.

BRIEF DESCRIPTION OF PRESENT INVENTION

According to the present invention a rock bolt comprises an elongate member having a headed end. The shank of the mine roof bolt includes an elongate hollow central portion having a transverse cross-section which is polygonal in nature. Preferred forms are triangular and square; however, all other multi-sided cross-sections can be utilized. Extending outwardly from the sides of the central core or central portion, are a series of ribs, the edges of which will essentially describe a circle that is slightly larger than the circle of the hole within which the mine bolt is to be placed. The bolt is constructed of material whereby the sides of the polygonal cross-section of the hollow central portion of such bolt can be resiliently flexed inwardly upon bolt installation, whereby to provide forces of compression acting outwardly upon the fins, the fins themselves being compressive members to supply compressive forces at their edges to the contact areas of the hole wall. The structure is designed for easy grouting by virtue of a countercurrent flow relative to the grout. A suitably configured bearing plate can be utilized, the same having fin slots to accommodate free placement of the bearing plate over the remote end of the mine bolt and back to the headed end thereof prepatory to impact implacement of the mine bolt in mine roof hole. A suitable impact tool or impact providing tool is also included.

BRIEF DESCRIPTION OF THE DRAWINGS

The present invention may best be understood by reference to the following description, taken in connection with the accompanying drawings in which.

DETAILED DESCRIPTION OF PREFERRED EMBODIMENTS

Figure 1:
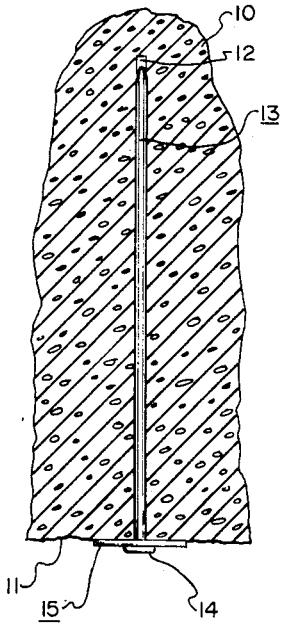
FIG. 1 is a fragmentary cut-away view of a rock formation structure showing the bolt of the present invention as being installed.

In FIG. 1 rock formation structure 10 is shown to include a lower surface 11 which is to be supported by an upwardly extending hole or aperture 12. Impact-urged rock bolt 13 is implaced in aperture 12, the same having a flange or lip 14 which retains bearing plate 15. Rock bolt 13, shown in greater detail in FIG. 2, includes an elongate hollow central portion 16 and a series of fins that can be serrated at their edges at E and which are inwardly tapered at 18 proximate the remote end of hollow central portion 16. The remote end 19 is shown to be opposite to near or proximate end 20 of the rock bolt.

Figure 3A:
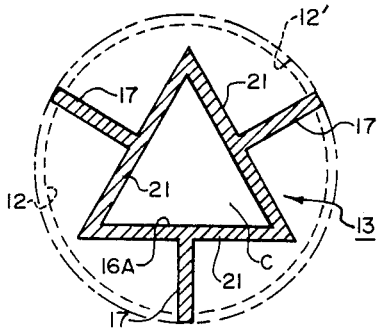
FIGS. 3A and 3B illustrate alternate transverse cross-sections of the bolt at FIG. 2, and are both taken along the line 3—3 in FIG. 2.
Figure 2:
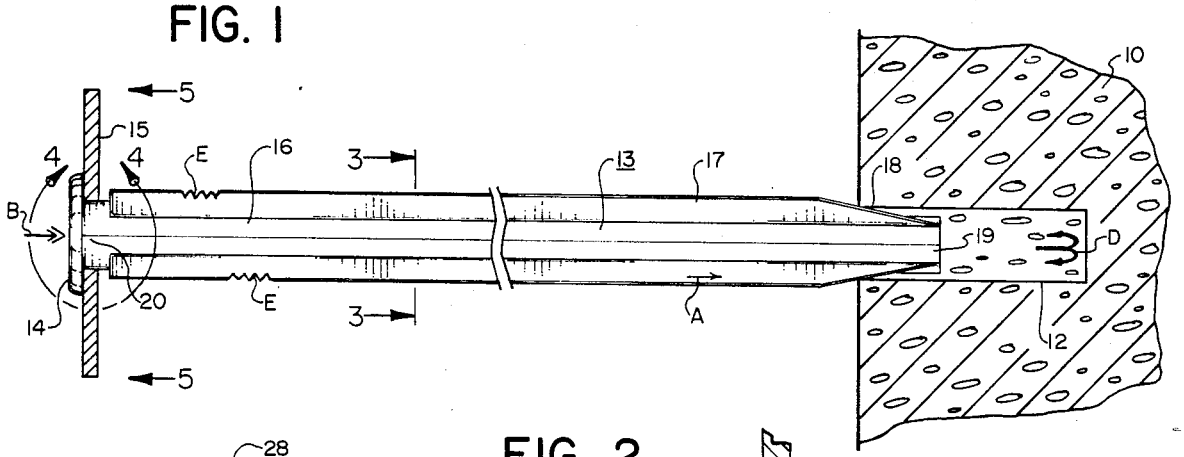
FIG. 2 is an enlarged side elevation of the rock bolt of the present invention in its initial implacement in a mine roof hole preparatory to impact installation therein.

The transverse vertical cross-section taken along the line 3—3 in FIG. 2 will be a polygon and, in one form of the invention, may comprise an equilateral triangle as in the case of corresponding central portion 16A in FIG. 3A. Accordingly, the fins 17 will be integral with respective sides 21 of central portion 16A and the outermost edge extremities of fins 17 will describe as to their locus a circle that is slightly larger than the circular aperture 12 of the mine roof. For example, where the rock formation aperture has a cross-sectional diameter of $1\frac{3}{8}$ inches, then the diameter of the circle described by the locus 12' connecting the outermost edges of the fins will be $1\frac{1}{2}$ inches. The several sides 21 of central portion 16 must be capable of sufficient resilient flexure such that, when the rock bolt is impacted into aperture 10, the fins will be directed inwardly so as to deflect inwardly or flex the sides 21 in accordance with the condition shown in FIG. 6A. In such event the locus circle 12' will then substantially coincide with the hole 12. Accordingly, the fins 17 will engage the hole wall of aperture 12 in compression, thus increasing the frictional retentive forces of the hole relative to the inserted roof bolt and also placing the rock formation surrounding the hole in compression at the points of fin contact therewith. Accordingly, there is an increased gripping action, by virtue of the compression in fins 17 and the resilient flexure in sides 21 so as to increase the holding power to the bolt.

Figure 3B:
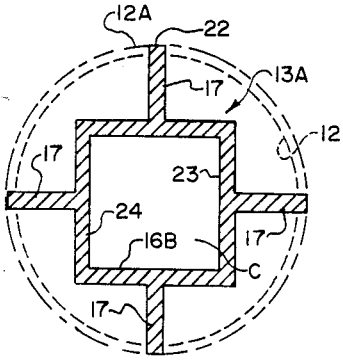
Figure 6A:
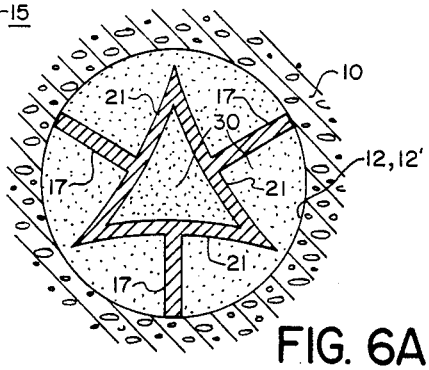
FIGS. 6A and 6B are fragmentary views of the structures of FIGS. 3A and 3B, respectively, wherein the rock bolt has been impacted inserted into the hole and the compression forces set up in the structure by virtue of the resilient flexure of the sides of the central portion of the bolt and the resultant compression of the fins against the hole walls at the fin edges.
Figure 6B:
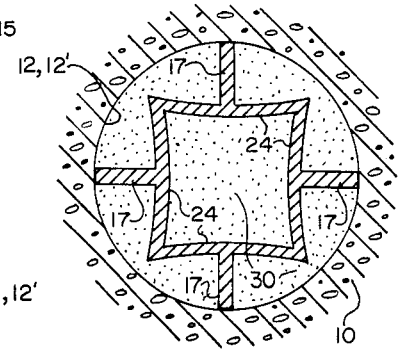

FIG. 3B illustrates another type of polygon cross-section wherein the cross-section of the elongate hollow central portion 16, now shown as 16B, is rectangular and preferably square. In such event the outwardly projecting fins which are integral with central portion 16B in FIG. 3B will have of course outer edges 22, the locus of which at 12A will describe a circle slightly larger than the hole circle of aperture 12. In similar vein, and as seen in FIG. 6B, when the roof bolt is impacted into mine roof aperture 12, then there will be an inward resilient flexure of all of the sides 23 in FIG. 3B, as is illustrated by the flexure of a representative side 24 in FIG. 6B, thus placing in compression each of the fins 17 which project outwardly from the respective resilient sides of the central portion, now at 16B. Thus, the fins will be in compression and will be sustained in such condition by virtue of the outward resilient force of each of the sides of central portion 16B, thus placing the rock formation surrounding the hole in compressino at the points of contact of the fins with the hole wall.

Thus, when the rock bolt is impacted into the mine roof aperture, then the locus circle of the fin edges will be essentially congruent with the cross-sectional circle of aperture 12.

Figure 2A:
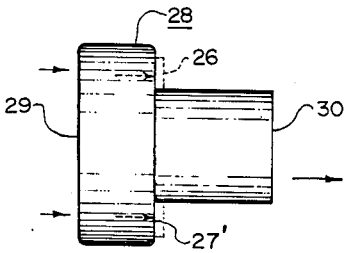
FIG. 2A is a side elevation of an impact tool or impact accommodating tool that can be utilized with the bolt of FIG. 2.
Figure 4:
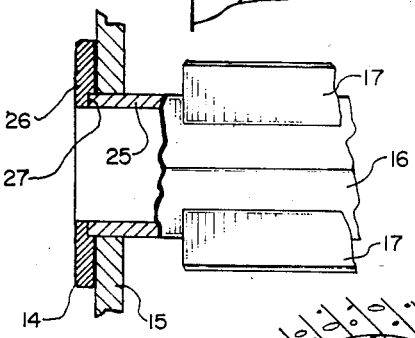
FIG. 4 is an enlarged detail of an alternate headed end supplied the bolt of FIG. 2, and is taken along the arcuate line 4—4 in FIG. 2.

Near end 20 of the roof bolt may have any type of configured ends of which the rolled or flared flange at 14 is representative. Alternatively, the end 25 of central portion 16 may be fitted into a provided ring which includes a shoulder 27 for this purpose. Ring 26 will comprise an impact ring for receiving, by way of example, the impact thrust of annular surface 27' of the impact tool 28 of FIG. 2A. This impact tool may include a head 29 and an insert stem 30 integrally formed therewith. Accordingly, the insert stem whether circular, triangular or square as to cross-section, can be used for the thrusting home of the roof bolt into the aperture 12 of the mine roof formation. Of course, the same tool as seen in FIG. 2A may be employed to impact the rolled end 14 of the roof bolt as seen in FIG. 2.

The bolts can be fabricated or simply extruded, with the fin ends later being tapered by a suitable machine. It is essential of course that there would be a capability of resilient flexure relative to the sides 21 and 23 by way of example, in FIGS. 3A and 3B. One type of material that can be used for fabricating the rock bolts 13 is a general purpose, high-strength-low alloy steel, with an intermediate carbon content. One representative type of such steel would have a yield point of 60,000 psi and a tensile strength of 75,000 psi. Other types of materials, of course, can be used, so long as there is the flexure requisite in permitting a slight inner compression against the aperture walls of the rock formation structure.

Figure 5:
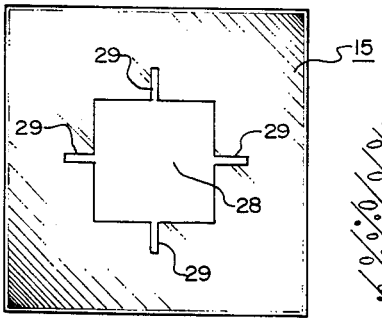
FIG. 5 is a plan view of a bearing plate that can be utilized in connection with the headed end of the rock bolt of FIGS. 1 and 2.

Relative to FIGS. 1 and 5, bearing plate 15 may have any type of periphery and in any event comprises a flat plate having a central aperture 28 corresponding to the transverse cross-section of central portion 16 of the roof bolt. In FIG. 5, the same is essentially square, corresponding with and slightly larger than the square cross-section seen in FIG. 3B. Where the triangularly-shaped roof bolt is used, see FIG. 3A, then the central aperture 28 will take a similar triangular form. In both cases, however, there will be provided outwardly extending fin slots 29 to accommodate the fins 17. These slots will be slightly larger in extent and width so as to allow the plates to be easily slipped over the end of the roof bolt prior to installation, and urged conveniently upwardly proximate the headed end of the roof bolt at 14, to be retained thereby. The bearing plate 15 may be provided with additional apertures which can be threaded for installation of eye bolts and/or have additional structures as may be needed for a particular rock bolt installation. For installation, a conventional epoxy material may be pre-inserted in the hole and then the rock bolt simply impacted into the hole so that the epoxy mix material will rigidly secure the remote portion of the mine bolt into the structure in addition to relying upon the fin compression function hitherto explained. An alternative installation would be first to impact the rock bolt in position in the direction of Arrow A in FIG. 2 and, once the same is completely installed as seen in FIG. 1, then to pump under pressure a suitable cementitious grout as shown by Arrow B, through the central aperture C of the hollow central portion of the bolt. Where the hole aperture 12 is longer than the bolt, as would be necessary in the case of grout implacement, then the grout can simply be forced through the internal aperture and then doubled back in progression, as shown by the double Arrow D through the cavaties between the fins. This is seen in FIGS. 6A and 6B. Accordingly, the grout 30 will further aid in a secure implacement of the rock bolts. Thus, the line of grout traveled, prior to its setting up, will be through the interior of the bolt and then doubled back between the fins and against the wall of aperture 12.

What is provided therefore is a new and useful rock bolt and components, and installation which will be essentially satisfactory in effecting bolt retention with a minimizing of possible corrosion since it is only the fin edges that contact the wall.

While it is contemplated that the principal usage of the rock bolt construction will be as a mine roof bolt, it will be understood, from use of the generic term "rock bolt", that the same can be used in mine ribs and floors, underground caves, tunnels, storage vaults, and other rock formation, and toxic waste repositories, underground power stations, or other caverns, and so forth.

While particular embodiments of the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of this invention.

I claim:

1. In combination an elongate rock bolt comprising an elongate, completely hollow central portion, of essentially uniform cross-section, have interiorly open near and remote ends and a transverse polygonal cross-section defined by plurality of mutually contiguous axially elongate sides constructed for and capable of inward resilient flexure, plural elongate fins, the locus of the edges of which define a cylinder, disposed along, integral with, and projecting centrally outwardly from respective ones of said sides, said fins bieng tapered solely proximate and toward said remote end, said near end being constructed to receive impact blows; a rock formation having a bore hole provided a cylindrical wall nominally less in transverse cross-section than said locus, said bore hole being deeper than the length of said elongate central portion and receiving said elongate central portion, said fin edges compression-engaging said bore hole wall; and grout means forced through said central portion to and about said remote end thereof for disposition between said fins and against said bore hole wall, for cementing in said rock bolt within said bore hole.

2. The structure of claim 1 wherein said near end has a radially outwardly turned circumferential lip.

3. The structure of claim 1 wherein said near end is provided with a fixed impact receiving ring.

4. The structure of claim 1 wherein said central portion has a rectangular transverse cross-section, said ribs projecting outwardly from respective central areas of said sides.

5. The structure of claim 1 wherein said central portion has a square transverse cross-section, said ribs projecting outwardly from respective central areas of said sides.

6. The structure of claim 1 wherein said near end is provided with a movable bearing plate having a central aperture provided with outwardly extending slots registering with said fins, said near end having a head configured to retain said bearing plate against said rock formation.

7. As an installation in the rock-bolt-accommodating aperture, having an aperture wall, of a rock-formation surface: an elongate rock bolt having an elongate hollow central portion provided with near and remote ends and having a tranverse polygonal cross-section defined by a plurality of mutually contiguous sides constructed for and capable of inward resilient flexure, plural elongate fins having outermost edges and disposed along, integral with, and projecting centrally outwardly from respective ones of said sides, the outermost edges of said fins conjointly describing a circle slightly greater in size than the cross-section of said rock bolt accommodating aperture, said fins being tapered inwardly proximate said remote end, said elongate mine roof bolt being impact-driven into said rock bolt accommodating aperture, remote end first, whereby said sides are deflected inwardly to offer compressive forces outwardly to said fins against the wall of said aperture and thereby maintain, through compressive force interaction between outermost fin edges and the said wall of said aperture contacting said fin edges, the integrity of said mine roof and increase the retention forces of said rock formation.

8. The structure of claim 7 wherein grout is disposed within said hollow central portion and back between said fins, essentially filling, with said mine bolt, said bolt-access aperture.

9. The structure of claim 7 wherein a bearing plate, provided with a central aperture having fin accommodating slots, is disposed on said rock bolt, said central portion having retention means for securing said bearing plate against said rock formation surface.

10. A method of securing a rock bolt to a rock formation having an elongate aperture, provided an aoerture wall, and longer than said rock bolt, for receiving said bolt, comprising the steps of: providing a rock bolt having a radially inwardly deflectable, resilient hollow core, open at both ends, and radially outwardly projecting fins a locus of the radially outward edges of which describe a circle slightly larger than the transverse cross-section of said rock formation aperture; impact-driving said bolt into said aperture whereby said bolt core is deflected circumferentially inwardly, whereby to create compressive forces at said fins, now deflected inwardly, against corresponding points of said aperture wall as contact said fins, and forcing grout through said core aperture and in a reverse direction between said fins, against said core and against said aperture wall, whereby to grout in said bolt in said aperture.

* * * * *